US005291626A

United States Patent [19]

Molnar et al.

[11] Patent Number: 5,291,626

[45] Date of Patent: Mar. 8, 1994

[54] MACHINE FOR CLEANSING ARTICLES

[75] Inventors: Barbara D. Molnar, Clifton Park; Donald T. McGrath, Scotia; Mark E. Dausch; Vivek V. Badami, both of Schenectady; Walter Whipple, III, Amsterdam, all of N.Y.

[73] Assignee: General Electric Company, Schenectady, N.Y.

[21] Appl. No.: 877,303

[22] Filed: May 1, 1992

[51] Int. Cl.[5] ..... D06F 33/02; A47L 15/46

[52] U.S. Cl. ..... 8/158; 68/12.02; 134/57 D; 356/339

[58] Field of Search ..... 68/12.02; 134/57 D, 134/113; 356/339, 442; 8/158

[56] References Cited

U.S. PATENT DOCUMENTS

| | | | |
|---|---|---|---|
| 2,874,606 | 2/1959 | Leiterer | 356/339 X |
| 3,234,846 | 2/1966 | Cropper et al. | 356/339 |
| 3,775,013 | 11/1973 | Simms | 356/442 |
| 4,037,966 | 7/1977 | Hill | 356/442 |
| 4,053,229 | 10/1977 | McCluney | 356/339 X |
| 5,067,814 | 11/1991 | Suzuki et al. | 356/339 |
| 5,136,861 | 8/1992 | Kiuchi et al. | 68/12.04 |
| 5,140,168 | 8/1992 | King | 356/442 X |
| 5,172,572 | 12/1992 | Ono | 68/12.02 |

FOREIGN PATENT DOCUMENTS

| | | | |
|---|---|---|---|
| 2158397 | 5/1973 | Fed. Rep. of Germany | 356/441 |
| 2711555 | 9/1978 | Fed. Rep. of Germany | 359/339 |
| 1274797 | 11/1989 | Japan . | |
| 2077296 | 3/1990 | Japan . | |

OTHER PUBLICATIONS

"Home Appliances", Chapter 16 of Sensors: A Comprehensive Survey, vol. 1, edited by W. Gopel, J. Hesse, and J. N. Zemel (1989).

"A New Sensing Device for Washing Machines," by Antonio Boscolo and Sergio Stibelli, published in IEEE Transactions on Industry Applications, vol. 24, No. 3, May/Jun. 1988.

Hach Company Ratio 2000 Turbidimeter Instruction Manual.

"Invisible at Home, Fuzzy Logic Crosses the Pacific and Bursts Out All Over", published by Computergram International on Feb. 5, 1991.

"WCI Differentiates its Brands: Presents Restyled Lines Aimed at Specific Retail Channels; WCI Appliance Group", published by the Weekly Home Furnishings Newspaper on Feb. 4, 1991.

"The Future of Electronics Looks 'Fuzzy'", published in The Washington Post on Dec. 23, 1990.

"Fuzzy Logic" published in Popular Science in Jul. 1990.

*Primary Examiner*—Philip R. Coe

*Attorney, Agent, or Firm*—Marvin Snyder

[57] ABSTRACT

A machine for cleansing articles, such as a dishwasher, incorporates a device for measuring the turbidity of an at least partially transparent liquid. The device includes a sensor for detecting scattered electromagnetic radiation, regardless of polarization, and a sensor for detecting transmitted electromagnetic radiation, regardless of polarization.

28 Claims, 4 Drawing Sheets

MACHINE FOR CLEANSING ARTICLES

RELATED APPLICATIONS

This application is related to patent application Ser. No. 07/877,310, entitled "Sensor Holder for a Machine for Cleansing Articles" by Dausch et al., filed May 1, 1992, patent application Ser. No. 07/877,304, entitled "Fluid-Handling Machine Incorporating a Closed Loop System for Controlling Machine Load," by Whipple, III et al., filed May 1, 1992, patent application Ser. No. 907/877,305 entitled "Device for Monitoring Load," by Whipple, III, filed May 1, 1992, patent application Ser. No. 07/877,301 entitled "A Fuzzy Logic Control Method for Reducing Water Consumption in a Machine for Washing Articles," by Badami et al., patent application Ser. No. 07/877,300 entitled "Fluid-Handling Machine Incorporating a Closed Loop System for Controlling Liquid Load," by Dausch et al., filed May 1, 1992, and to patent application Ser. No. 07/877,302 entitled "A Fuzzy Logic Control Method for Reducing Energy Consumption in a Machine for Washing Articles," by Dausch et al., filed May 1, 1992. The aforesaid patent applications are assigned to the assignee of the present invention and herein incorporated by reference.

FIELD OF THE INVENTION

The invention is generally directed to a method and apparatus for cleansing articles and, more particularly, relates to employing a liquid to cleanse articles in a manner determined at least in part by the turbidity of the liquid.

BACKGROUND OF THE INVENTION

Reducing the amount of energy consumed by a machine for cleansing articles, such as a clothes washer, is a significant problem, in part because of increasing energy costs. In such a machine, the amount of energy consumed is primarily determined by the amount of energy needed to heat the liquid, such as water, used to cleanse the articles. Thus, decreased liquid consumption for such machines may result in a significant improvement in energy efficiency.

Appliances for cleansing articles, such as clothes washers, are typically preprogrammed to perform a complete washing in a predetermined number of wash cycles, each wash cycle having a predetermined duration. A wash cycle may comprise providing substantially particle-free liquid to the machine, circulating the liquid during the wash cycle, and draining or flushing the liquid from the machine after being used to wash or cleanse the articles. Often the machine user may select from a limited number of preprogrammed options. Such preprogramming does not use energy efficiently because the machine may either perform an excessive number of wash cycles, or perform each cycle for an excessive duration, to assure that cleanliness of the articles is achieved. To improve the energy efficiency of such appliances, closed loop feedback control has been introduced. Several techniques are available to indirectly monitor cleanliness of the articles during closed loop feedback control of the appliance, including use of a device for measuring the turbidity of the liquid used to wash the articles.

Devices for measuring turbidity that detect the transmission of light propagated through water used to wash the articles have been employed to ascertain information about progress of the wash. However, these devices are not ideal for use in household appliances. Such devices are oftentimes difficult or non-economic to implement due to the electronic circuitry necessary to perform the complex turbidity measurements. Furthermore, such devices are subject to measurement error. Factors such as water turbulence, cloudiness of the water sample chamber, light source dimming, or device performance degradation may cause attenuation of the amount of light detected and thus affect measurement accuracy. The precision of such devices is also not entirely satisfactory. This imprecision has the additional effect of making turbidity measurements provided by such devices difficult to interpret in a closed loop feedback control system.

A need thus exists for a machine for cleansing articles incorporating a device for measuring turbidity in which the device is simple and economic to produce, provides the capability to compensate for signal attenuation, and provides improved turbidity measurement precision. A need also exists for a closed loop feedback control system sophisticated enough to utilize the measurements from such a turbidity measuring device effectively.

SUMMARY OF THE INVENTION

One object of the invention is to provide a turbidity measuring device that detects scattered electromagnetic radiation, regardless of polarization, and a machine for cleansing articles that incorporates such a device.

Another object is to provide a turbidity measuring device capable of being used in a fuzzy logic feedback control system providing either continuous, periodic, or batch mode closed loop feedback control, and a machine for cleansing articles incorporating such a device and fuzzy logic feedback control system.

An additional object is to provide a turbidity measuring device capable of self-calibration and adjusting for signal attenuation, and a machine for cleansing articles incorporating such a device.

Still another object is to provide a turbidity measuring device in a closed loop feedback control system capable of modifying the duration and number of wash cycles of a machine for cleansing articles, and a machine for cleansing articles that incorporates such a closed loop feedback control system.

One more object is to provide a turbidity measuring device with sufficient precision that is simpler and more economic than those currently available, and a machine for cleansing articles that incorporates such a device.

In accordance with the invention, a machine for cleansing articles, such as a dishwasher, is provided that incorporates a sensor for detecting scattered electromagnetic radiation, regardless of polarization. The radiation is scattered by propagating it through a liquid used to wash the articles. The machine includes a controller responsive to the sensor, a frame for containing articles during a washing or cleansing, and a system, integral to the frame, for washing or cleansing articles in response to the controller.

BRIEF DESCRIPTION OF THE DRAWINGS

The subject matter regarded as the invention is particularly pointed out and distinctly claimed in the concluding portion of the specification. The invention, however, both as to organization and method of operation, together with further objects and advantages thereof, may best be understood by reference to the following detailed description when read with the accompanying drawings in which:

DETAILED DESCRIPTION OF THE INVENTION

Figure 1:
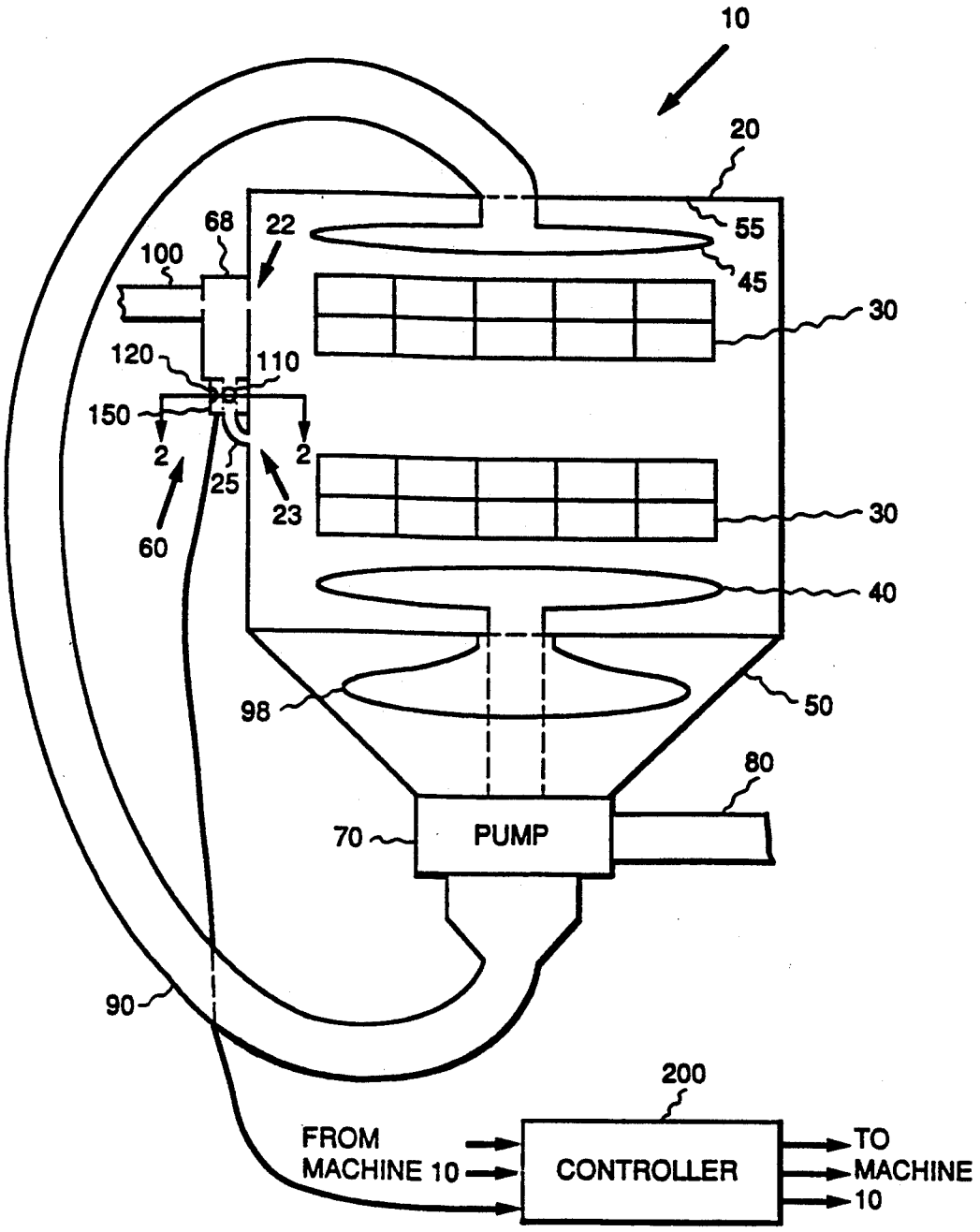
FIG. 1 is a schematic diagram of a machine for cleansing articles incorporating a device for measuring the turbidity of liquid in accordance with the invention.

FIG. 1 illustrates a machine 10 for cleansing or washing articles in accordance with the invention. Machine 10 comprises, in combination, a frame 20 for containing articles during a washing or cleansing, a device 60 for measuring the turbidity of the liquid, such as water, used to cleanse or wash the articles, a controller 200 responsive to measurements provided by device 60, and a system, integral to frame 20, for cleansing or washing articles in response to controller 200. Machine 10 illustrated in FIG. 1 further includes a sample collector 68 mounted to machine 10 and attached to device 60, and a heating element 98. The specific configuration of a system for washing or cleansing articles, such as the particular subsystems included, will depend in part on the type of machine for washing or cleansing the articles. For example, as illustrated in FIG. 1, the system for washing articles in a dishwasher may include: a subsystem to distribute and recirculate liquid, such as water, which might include a sump 50 of frame 20, a spray arm 40 rotatably connected to pump 70, a spray arm 45 rotatably connected to ceiling 55 of frame 20, and a recirculation hose 90 connecting spray arm 45 to pump 70; a subsystem to provide substantially particle-free liquid, such as conduit 100 connected to frame 20 through a sample collector 68, device 60, a tube 25, and an aperture 23 in the frame; and a subsystem to remove water, which may include sump 50, pump 70, and an outlet 80. A system for washing articles in a dishwasher may further include a subsystem to heat the water, which may include a heating element 98 in sump 50 and a device for measuring liquid temperature (not shown). The subsystems of the system for washing or cleansing articles operate together to handle the liquid, such as water, during the washing or cleansing. FIG. 1 also illustrates racks 30 for holding or storing food handling items during a washing or cleansing.

In the context of this invention, the turbidity of a liquid, such as water, refers to the amount of particles suspended in the liquid per unit volume. The use of a turbidity measuring device in dishwashers raises considerations not typically encountered in other washing or cleansing environments. For example, less liquid is typically employed in dishwashers than in other cleansing systems or machines, such as a clothes washer. Furthermore, frequently food handling items retain more particles to be removed during the washing or cleansing than in other cleansing or washing environments, such as in a clothes washer. Thus, the concentration of particles in the liquid for washing the articles in a dishwasher is typically of a level so that some devices for measuring turbidity, such as devices measuring light transmittance only, may prove inferior or inadequate in a dishwasher. This is further exacerbated by the fact that the liquid flow rate in a dishwasher and the type of liquid distribution, such as liquid spraying or aeration, may have a greater tendency to keep particles in suspension than for other cleansing systems, such as a clothes washer. The detergents used to wash or cleanse food handling items may also contribute to such particle suspension.

Another problem encountered in using a turbidity measuring device in a dishwasher that may not typically occur in other machines for cleansing articles, such as a clothes washer, results from the aeration or spraying of the liquid, mentioned earlier. This type of liquid circulation or distribution may have a tendency to produce more liquid turbulence and air bubbles than in other cleansing environments not employing this form of liquid circulation or distribution. Thus, obtaining satisfactory turbidity measurements in this environment is difficult in comparison with other cleansing systems employing less liquid aeration or spraying as part of the cleansing or washing process. This effect is possibly increased by the fact that dishwashers typically employ less liquid per wash cycle than other cleansing systems, such as clothes washers.

Yet another aspect of employing a turbidity measuring device in a cleansing or washing machine, such as dishwasher, is a desire to obtain better turbidity measurements than may be useful in other cleansing systems or machines, such as clothes washers, due to differences in the cleansing or washing process. For example, a dishwasher typically includes a subsystem to heat the liquid whereas a clothes washer typically does not. Thus, a turbidity measuring device having the capability to ascertain the composition of contaminants in the liquid used to cleanse the articles may prove particularly useful in a dishwasher to have the capability to make determinations about heating the liquid. The capability to make such determinations and, thus, impose such heating control may improve energy efficiency, yet, in a cleansing system without a subsystem to heat the liquids this turbidity measurement capability may not prove as useful. Heating the liquid and likewise the turbidity of the liquid in a cleansing system, such as dishwasher, may have additional significance because of the nature of the articles being cleansed. If not properly cleansed, food handling items may pass bacteria or other organisms to food that the food handling items contact directly. Yet, a turbidity measuring device addressing the aforesaid considerations in a dishwasher must still prove economical enough to include in a household appliance.

Figure 2:
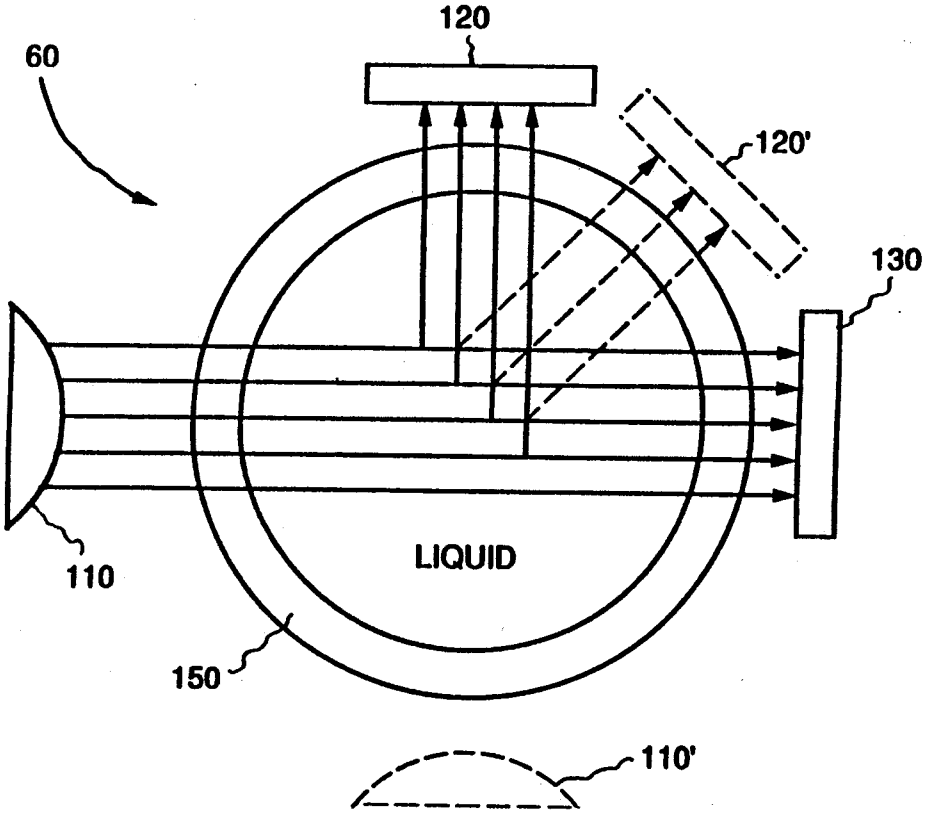
FIG. 2 is a section view along line 2—2 in FIG. 1 illustrating, with light rays represented by arrows, three alternative embodiments of a device for measuring the turbidity of liquid, for incorporation into a machine for cleansing articles in accordance with the invention.

Device 60 for measuring the turbidity of a liquid, such as water, is shown in FIG. 1 as including a source 110 of electromagnetic radiation and a sensor 120 for detecting scattered electromagnetic radiation, regardless of polarization. A sensor 130 for detecting transmitted electromagnetic radiation, regardless of polarization, although not shown in FIG. 1 is illustrated in FIG. 2, a schematic diagram of three alternative embodiments of a device for measuring the turbidity of liquid, such as water. The radiation sensors and source are disposed in a housing 150, illustrated in FIGS. 1 and 2.

A signal input to controller 200, as shown in FIG. 1, is a turbidity measurement, provided by device 60, of the water or liquid used in machine 10 to wash or cleanse the articles. A number of other signals from machine 10, such as signals conveying information about progress of a washing or cleansing or of a particular wash cycle, may also be provided to controller 200. Signal outputs provided by controller 200 to machine 10 for feedback control include signals to control the number of wash cycles to be executed, to control the duration of these wash cycles, and to control heating element 98, for example. Other signal outputs for controlling a washing may also be provided by washing or cleansing controller 200.

Device 60 in FIG. 1 is shown attached to sample collector 68. Device 60 and sample collector 68 form a sensor holder system, such as disclosed in aforesaid patent application Ser. No. 07/877,310. As illustrated in FIG. 1, a plurality of apertures 22 in frame 20 permit liquid to escape frame 20 during the distribution or circulation of liquid in machine 10. FIG. 1 provides a side view of the wall containing the plurality of apertures 22. The liquid, including particles in suspension, such as removed from the articles during the washing or cleansing, is received by sample collector 68 through plurality of apertures 22. The liquid flows from sample collector 68 back into machine 10 via tube 25 which connects sample collector 68 to machine 10 through aperture 23, in the frame below the plurality of apertures 22. A portion of tube 25 not shown connects to sample collector 68 through device 60. As liquid moves through tube 25, device 60 obtains turbidity measurements of the liquid, such as water. It will be understood that conduit 100, sample collector 68, device 60, tube 25 and aperture 23 may, in combination, also provide substantially particle-free liquid to machine 10 and may provide the capability to perform self-calibration of device 60 as substantially particle-free liquid flows through tube 25 in the region of device 60.

Machine 10 includes many possible locations for device 60. It will be understood that although the invention is not limited to any particular location for device 60, the location must be particularly suited to overcome the particular problems associated with obtaining turbidity measurements, such as liquid turbulence or air bubbles. As disclosed and described in aforesaid patent application Ser. No. 07/877,310, several factors, such as avoidance of clogging, device self-calibration, isolation of device electronics, recirculation of water, and diffusion of air bubbles, affect the determination of where to position device 60 relative to frame 20 for effective turbidity measurements. The location of device 60 shown is merely illustrative. Furthermore, other sensor holder systems, such as disclosed in aforesaid patent application Ser. No. 07/877,310 provide alternatives to the sensor holder system illustrated in FIG. 1. This particular location for device 60, nonetheless, permits gravity to bring the liquid, such as water, directly in contact with device 60. Furthermore, in the configuration of machine 10 shown in FIG. 1, the liquid, such as water, used to wash the articles must ultimately flow past the position where device 60 is conveniently located. Device 60 of FIG. 1 for measuring turbidity should be of a type in which the liquid flows through the region between the radiation source and sensors at the time of obtaining a turbidity measurement.

Device 60 is not restricted to a specific frequency range or to a specific type of electromagnetic radiation. For example, although radiation source 110 may emit unpolarized light, the polarization of electromagnetic radiation propagated through the liquid, such as water, used to wash the articles is not important for satisfactory operation of device 60. Polarization of the electromagnetic radiation has no effect on satisfactory operation of device 60. Thus, as illustrated in FIG. 2, sensor 120 detects scattered electromagnetic radiation, regardless of polarization, and sensor 130 detects transmitted electromagnetic radiation, regardless of polarization.

The electromagnetic radiation detected by sensor 120 is scattered by propagation through the liquid, such as water, used to wash the articles. Scattering of the electromagnetic radiation results from particles suspended in the liquid and in the path of propagation of the radiation, such as particles removed from the articles during a wash cycle. In the context of the invention, scattering of electromagnetic radiation refers to any deviation of the radiation from its initial path. In the context of the invention, transmitting of electromagnetic radiation refers to electromagnetic radiation emitted from the source reaching a sensor without being deviated from its initial path. Transmitted electromagnetic radiation takes a direct path. In the context of this invention, direct path means the shortest path between the source and the radiation sensor. Radiation not scattered and not transmitted is absorbed by the media, in this case the water or liquid used to wash the articles, including any suspended particles.

Controller 200 may comprise a closed loop feedback control system including a microprocessor that may incorporate a linear or a non-linear closed loop feedback control algorithm. For example, the microprocessor may be programmed to implement a physically realizable frequency or time domain representation of a transfer function for a control system for an apparatus for washing or cleansing articles. Alternatively, the closed loop feedback control system may comprise a microprocessor incorporating a fuzzy logic feedback control algorithm, such as disclosed in aforesaid patent application Ser. No. 07/877,302. This fuzzy logic feedback control algorithm, or any other linear or non-linear closed loop feedback control algorithm, may control, based upon turbidity measurements, the number of wash cycles for a complete washing, the duration of the wash cycles, the temperature of the liquid used to wash the articles, or any combination thereof. Likewise, the closed loop feedback control system may comprise other types of processors, such as a microcontroller, an application specific integrated circuit (ASIC), a digital signal processor (DSP), or other processor which may incorporate a linear or non-linear closed loop feedback control algorithm. In the context of this invention, a wash cycle comprises providing substantially particle-free liquid, such as water, to the frame, circulating the water or liquid during the wash cycle, and draining or flushing the water or liquid from the frame after being used to wash the articles. A complete washing comprises washing the articles in one or more wash cycles until the articles are substantially free of particles. Nonetheless, it will be appreciated by those skilled in the art that a wash cycle may have other significant aspects, such as rinsing the articles, providing a rinsing agent, providing detergent or soap to clean the articles, or monitoring and adjusting the temperature of the water or liquid. Likewise, a complete wash cycle may include draining only a portion of the liquid used to wash the articles or providing only a portion of the substantially particle-free liquid necessary for a wash cycle. The former characterization of a wash cycle is not intended to exclude the latter aspects of a wash cycle.

A system for washing or cleansing articles, such as for washing laundry or food handling items, must operate for at least one wash cycle. A fuzzy logic feedback control algorithm, or any other linear or non-linear closed loop feedback control algorithm, may control the duration of that cycle. Furthermore, a system for washing articles may operate for a plurality of separate wash cycles during a particular washing and a closed loop feedback control algorithm may control the number of those wash cycles. Likewise, a closed loop feedback control algorithm may control both the number of wash cycles and the duration of each of those cycles. Thus, each cycle may have a different duration. The closed loop feedback control algorithm may also control the temperature of the liquid.

A closed loop feedback control algorithm, such as the fuzzy logic feedback control algorithm as disclosed in aforesaid patent application Ser. No. 07/877,302, may provide continuous closed loop feedback control of the system for washing articles, periodic, or discrete-time, closed loop feedback control, or batch mode closed loop feedback control. In periodic feedback control, the closed loop feedback control algorithm may incorporate, in real-time, sequences of turbidity measurements, such as several measurements per second, provided by the device for measuring the turbidity of liquid in accordance with the present invention. The closed loop feedback control algorithm uses the measurements to make determinations regarding the number of wash cycles, the duration of any particular wash cycle as the wash cycle progresses, or the appropriate time to heat the liquid used to wash the articles. It will be understood that the machine must likewise have the capability to measure the temperature of the liquid. In continuous closed loop feedback control, the device for measuring turbidity in accordance with the present invention continuously provides turbidity measurements and the closed loop feedback control algorithm continuously incorporates those measurements in real-time to make determinations regarding the execution of the washing or cleansing, as described above. In contrast, a closed loop feedback control algorithm may provide batch mode feedback control of the system for washing articles. A closed loop feedback control algorithm providing batch mode feedback control may, during a wash cycle, cause the controller to use at least one and possibly a plurality of turbidity measurements taken during a given wash cycle and based upon that information make a single or a limited number of separate determinations regarding the duration of the wash cycle, the number of wash cycles, the appropriate time to heat the liquid, or any combination thereof.

In an alternative embodiment, controller 200 may comprise a closed loop feedback control system including electronic circuitry for comparing a first signal produced by the sensor for detecting transmitted electromagnetic radiation with a second signal produced by the sensor for detecting scattered electromagnetic radiation. Thus, controller 200 may include a comparator. The electronic circuitry may incorporate analog electronic circuit components, digital electronic circuit components, or both. It will be appreciated by those skilled in the art that a multitude of possible electronic circuits may be designed and constructed to implement a multitude of possible closed loop feedback control systems. For example, an electronic circuit may be a physical realization of a frequency domain representation of a transfer function for a control system for an apparatus for washing or cleansing articles. A host of factors, including the particular type of machine for cleansing or washing articles, such as a dishwasher, will affect the determination of the particular transfer function to be realized and the electronic circuitry used to implement it.

It will be appreciated that still another embodiment of a closed loop feedback control system may include a microprocessor incorporating a look-up table in which wash cycle durations, the number of wash cycles for a washing, the heating of the liquid, or any combination thereof, are controlled for predetermined signal ranges for the signals provided by the device for measuring turbidity.

Controller 200 may furthermore comprise a closed loop feedback control system to control the washing or cleansing of articles in accordance with either the turbidity measurements obtained, any power consumption surges detected, as disclosed in aforesaid patent application Ser. No. 07/877,304, any liquid pressure surges detected, as disclosed in aforesaid patent application Ser. No. 07/877,300, or any combination thereof. Any of the previously described embodiments of a closed loop feedback control system may accomplish this, such as a microprocessor, or other processor, incorporating a closed loop feedback control algorithm, such as the fuzzy logic feedback control algorithms disclosed in aforesaid applications Ser. No. 07/877,301 and U.S. Ser. No. 07/877,302.

In FIG. 2, one of three alternative embodiments of a device for measuring the turbidity of liquid, such as water, to be incorporated into a machine for washing or cleansing articles includes radiation source 110, radiation sensor 120, and radiation sensor 130. In this embodiment, the sensor for detecting scattered electromagnetic radiation is located along an axis oriented substantially perpendicular to the axis defined by the path of transmitted light, or electromagnetic radiation, from source 110 to sensor 130. In an alternative embodiment, instead of sensor 120, a radiation sensor 120' (shown in phantom) for detecting scattered electromagnetic radiation may be located along an axis oriented at an acute angle relative to the axis defined by the path of transmitted electromagnetic radiation. It will be appreciated that the symmetry of the device illustrated in FIG. 2 permits sensors to be located at any position along the arc of a circle, such as the circle formed by the cylindrical wall of housing 150.

As illustrated in FIG. 2, a sensor located along an axis oriented at an acute angle relative to the axis defined by the path of transmitted electromagnetic radiation between source 110 and sensor 130, as illustrated by sensor 120', detects forward scatter of electromagnetic radiation. In contrast, a sensor (not shown) located along an axis oriented at an acute angle relative to the axis defined by the path of transmitted electromagnetic radiation may be positioned along the arc of a circle, such as formed by housing 150, between source 110 and sensor 120, for detecting back scatter of electromagnetic radiation.

Excellent performance is obtained from a device for measuring the turbidity of liquid, such as water, by including a sensor for detecting scattered electromagnetic radiation, regardless of polarization, and a sensor for detecting transmitted electromagnetic radiation, regardless of polarization. Thus, a machine for cleansing or washing articles incorporating a turbidity measuring device that includes these particular sensors will provide excellent results, especially for use in a dishwasher. Furthermore, where the device does not include a sensor for detecting transmitted electromagnetic radiation, regardless of polarization, adequate results may still be obtained in a machine for cleansing or washing articles, particularly a dishwasher.

A device for measuring turbidity incorporated in a machine for washing articles in accordance with the present invention provides several advantages. One advantage is that satisfactory performance of such a device, by its method of operation, imposes no theoretical limitations on size or shape of particles suspended in the liquid, such as water, that are to be detected. In addition, no restrictions regarding the frequency of the electromagnetic radiation or the particular type of electromagnetic radiation are imposed. However, radiation absorption bands of the liquid for cleansing the articles should be avoided. Thus, the invention is not limited in scope to unpolarized light radiation. Nonetheless, particular particle sizes or shapes may scatter more of the radiation incident upon a particle of that size or shape for a particular frequency or type of radiation.

Other advantages are provided because a device for measuring turbidity including both sensors provides the capability to adjust for attenuation of the detected radiation, such as may occur during device operation. For example, the radiation source may degrade over time. Alternatively, attenuation may result from cloudiness of the water sample chamber or from drift in the operating point of the device electronics. A measurement of the transmitted electromagnetic radiation provides a scaling factor to adjust for such attenuation, as well as providing other information useful for making precise and accurate turbidity measurements.

In addition, the sensor for detecting transmitted electromagnetic radiation in combination with the sensor for detecting scattered electromagnetic radiation significantly improves the measurement sensitivity or precision of the overall device. This improved sensitivity results from additional information regarding the turbidity of the liquid provided by the transmission of electromagnetic radiation through the water used to wash the articles. For example, if the liquid, such as water, is particularly dense with particles, a small amount of electromagnetic radiation may be scattered while a substantial amount of radiation is scattered or absorbed before reaching the detection region of either sensor. Thus, the detection of transmitted and scattered radiation is limited. On the other hand, if the turbidity of the water is slight, a substantial amount of transmitted radiation may be detected, while detection of scattered radiation may again be limited. Detecting the transmitted electromagnetic radiation, thus, provides information regarding the turbidity of the water in addition to the information gained from exclusively detecting the amount of electromagnetic radiation scattered. Thus, a device for measuring the turbidity of water including both types of sensors provides better performance than a device including only a sensor for detecting exclusively either the transmitted electromagnetic radiation or the scattered electromagnetic radiation.

In fact, as discussed previously, a turbidity measuring device including only a sensor for detecting transmitted electromagnetic radiation would likely provide inferior or inadequate performance in a dishwasher. Likewise, a device for measuring turbidity including only a sensor for detecting scattered electromagnetic radiation, regardless of polarization, would provide satisfactory results in a dishwasher, but would not provide the level of performance of a turbidity measuring device including both a sensor for detecting scattered electromagnetic radiation, regardless of polarization, and a sensor for detecting transmitted electromagnetic radiation, regardless of polarization. Detecting scattered electromagnetic radiation is usually more important for satisfactory performance in dishwashers in contrast with other cleansing systems, such as clothes washers, because the liquid used in dishwashers to cleanse the articles typically has more particles in suspension in the liquid to scatter the electromagnetic radiation. Thus, in a cleansing system environment such as a dishwasher, a sensor for detecting the scattered electromagnetic radiation offers the possibility for improved performance that may not be necessary in other cleansing environments, such as a clothes washer. Nonetheless, the type of liquid distribution or circulation in a dishwasher may also make it more difficult to obtain adequate turbidity measurements due to the possibility of liquid turbulence and air bubbles.

A device for measuring the turbidity of liquid to be incorporated in a machine for washing or cleansing articles in accordance with the present invention may include one sensor for detecting both transmitted electromagnetic radiation, regardless of polarization, and scattered electromagnetic radiation, regardless of polarization. For example, such a device may include two different radiation sources, such as source 110 and source 110' (shown in phantom) illustrated in FIG. 2, pulsed or multiplexed so that the sensor, such as sensor 120 illustrated in FIG. 2, detects, at different times, either scattered electromagnetic radiation or transmitted electromagnetic radiation, regardless of polarization. The sources should be properly oriented relative to the sensor so that the scattered or transmitted radiation can be detected. Adjustment of the relative intensities of the two sources may also be necessary for satisfactory performance.

Figure 3:
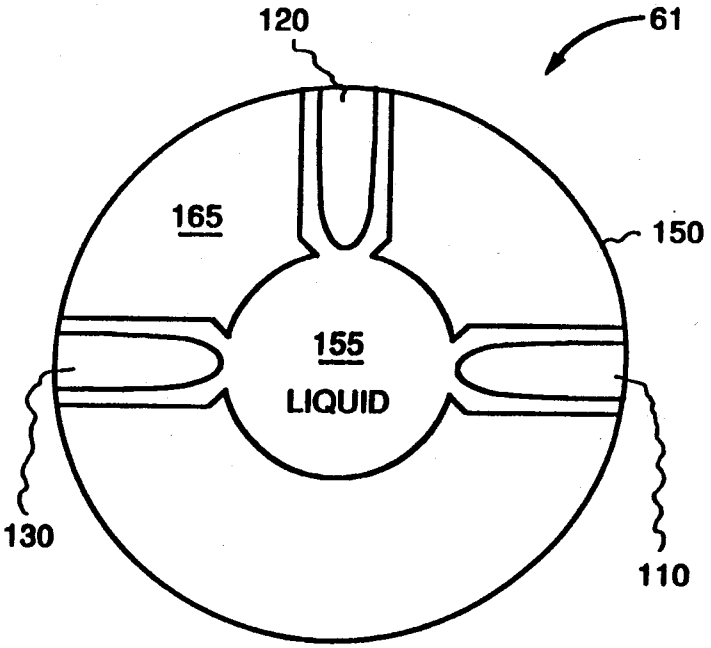
FIG. 3 is a plan view of an embodiment of a device for measuring the turbidity of liquid, for incorporation into a machine for cleansing articles in accordance with the invention.

FIG. 3 is a plan view of a device 61 for measuring the turbidity of liquid, such as water, in which the water is substantially non-turbulent at the time of measurement. This device may be incorporated in sump 50 of frame 20 or elsewhere in machine 10 of FIG. 1 where water will typically collect. FIG. 3 illustrates device housing 150 with a water sample chamber formed by base 155 and cylindrical wall 165. The wall, rising above the surface of the base, incorporates radiation source 110 and sensors 120 and 130, respectively. In this configuration the device retains or holds water in the water sample chamber as it measures turbidity. Nonetheless, the water need not be still during the turbidity measurement.

Figure 4:
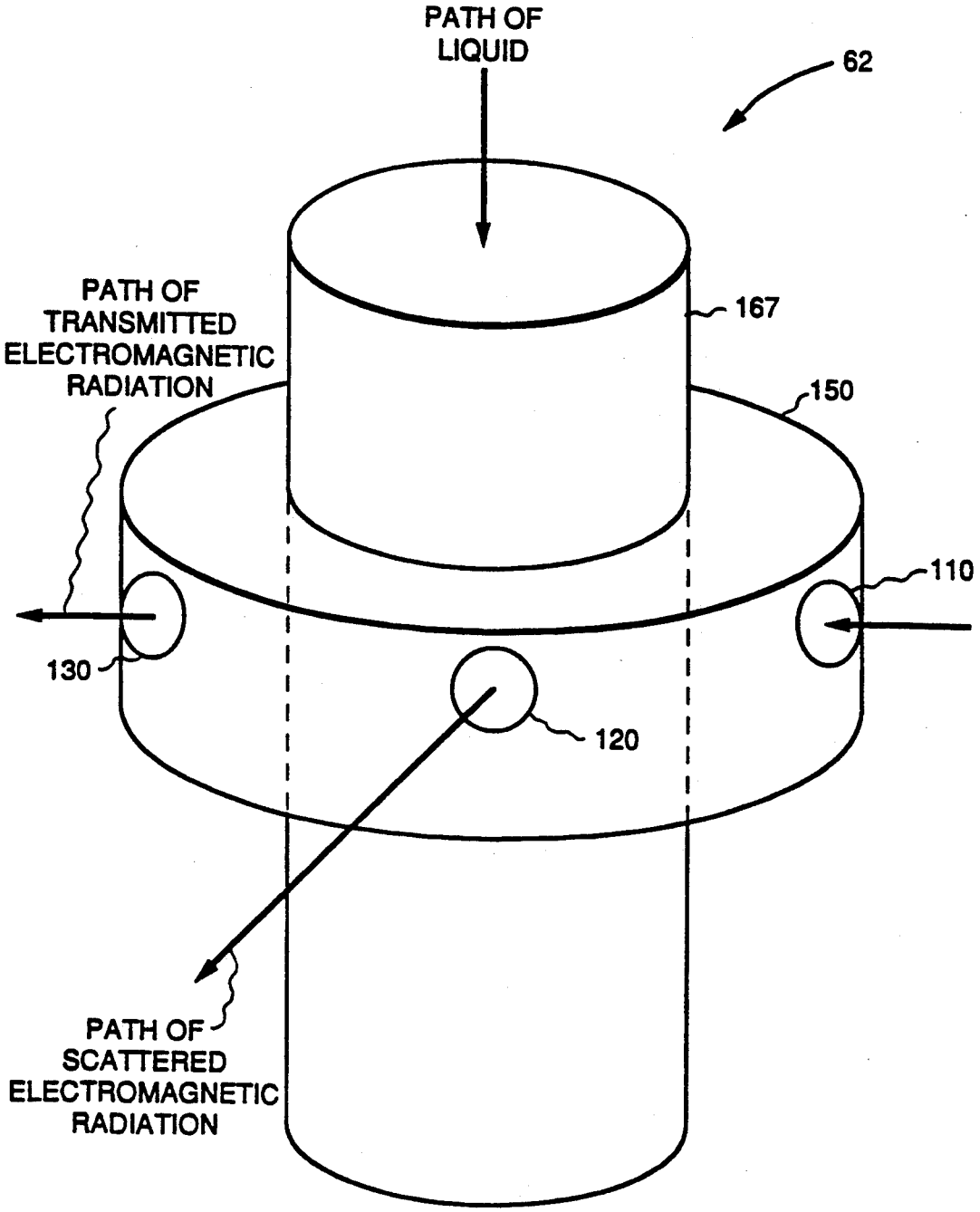
FIG. 4 is a perspective view of an alternative embodiment of a device for measuring the turbidity of liquid, for incorporation into a machine for cleansing articles in accordance with the invention.

FIG. 4 is a perspective view of another configuration of a device for measuring turbidity to be incorporated in a machine for washing or cleansing articles. In this configuration, the water is disposed in front of source 110, such as via a tube 167, and the turbidity of the water is measured as it flows through the tube in the region or water sample chamber between the radiation source and sensors. Thus, housing 150 in this configuration incorporates a transparent flow-through tube so that the device for measuring turbidity may be positioned in machine 10 of FIG. 1 in a location where liquid, such as water, circulates, such as attached to sample collector 68, as illustrated in FIG. 1.

Figure 5:
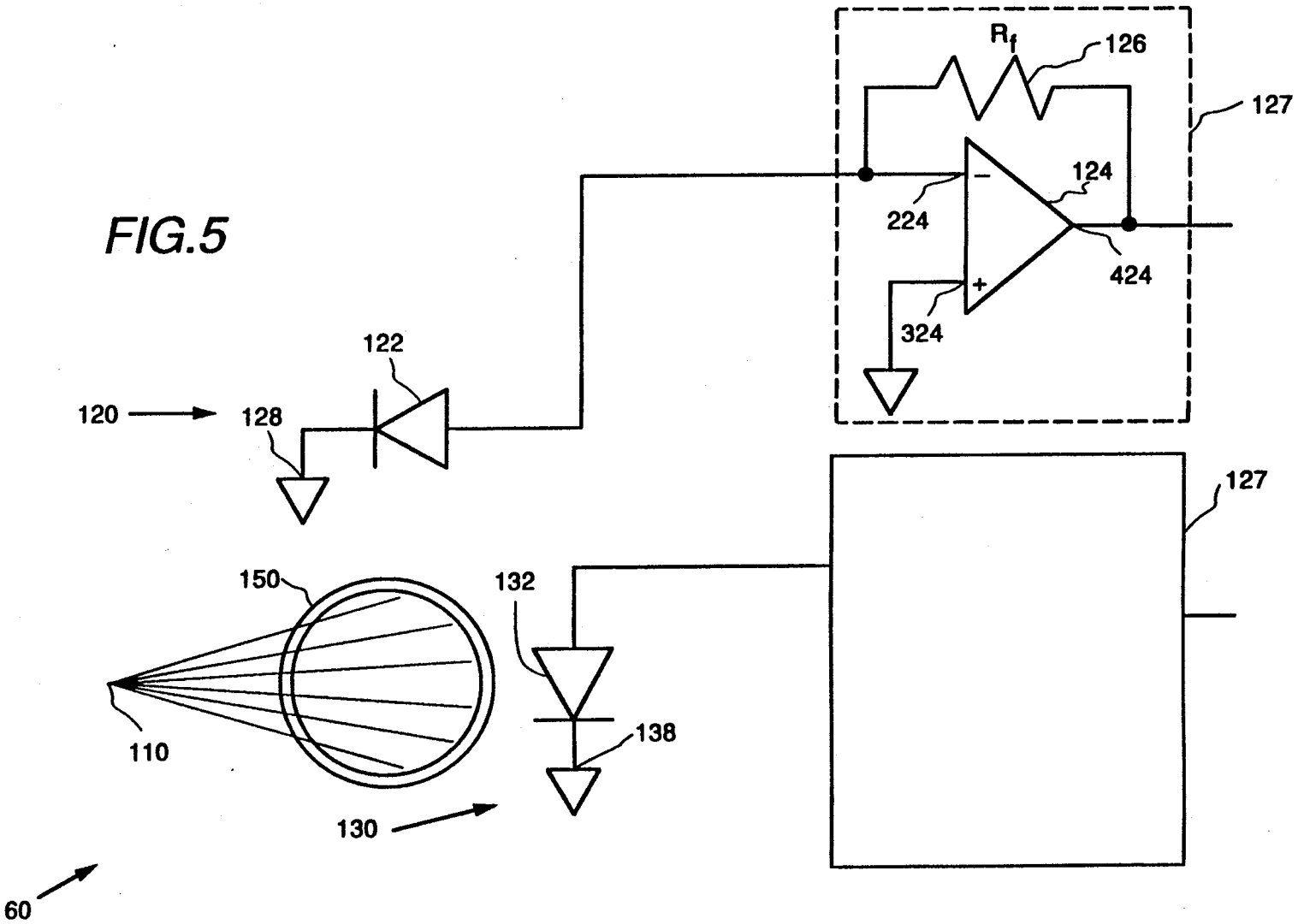
FIG. 5 is a schematic diagram showing electrical couplings for an embodiment of a device for measuring the turbidity of liquid, for incorporation into a machine for cleansing articles in accordance with the invention.

In the schematic diagram of FIG. 5, sensors 120 and 130 are each respectively illustrated as comprising a photodetector, such as photodiodes 122 and 132, respectively. Photodiodes 122 and 132 are each respectively coupled to essentially identical amplifier circuitry 127 which is described for photodiode 122 only. Thus, photodiode 122 is coupled to the negative input of an operational amplifier. The negative input 224 of operational amplifier 124 is likewise coupled to the output 424 thereof through a resistor in a feedback path, to calibrate the feedback gain. The positive input 324 is coupled to ground as is the cathode of photodiode 122. It will be appreciated that the feedback gain provided by amplifier circuitry 127 may differ for the respective photodiodes.

In operation, electromagnetic radiation incident upon either of photodiodes 122 and 132 shown in FIG. 5 produces a voltage across that photodiode. This voltage is provided to the amplifier circuitry 127 coupled to the radiated one of the photodiodes, for magnitude adjustment. Feedback resistor 126 in amplifier circuitry 127 should be chosen to adjust the voltage signal from the particular photodiode to provide a meaningful measurement of the amount of electromagnetic radiation detected by that photodiode.

It will be understood that the embodiment of the invention shown in FIG. 5 is provided for purposes of illustration and that the invention is not restricted in scope to this particular embodiment. Any sensor for detecting electromagnetic radiation may be employed in place of photodiodes 122 and 132. Other examples include photomultiplier tubes, optical pyrometers, bolometers, photovoltaics and others. The sensor may also comprise a light-to-frequency converter, such as TSL 220, or a light-to-analog converter, such as TSL 250, both available from Texas Instruments, Inc. Likewise, although possible sources of electromagnetic radiation include either an electrical lamp or a light emitting diode (LED), the invention is not restricted in scope to a particular source of electromagnetic radiation. Similarly, although operational amplifiers provide a convenient means to adjust the sensor signal, any one of a number of different types of amplifiers would provide satisfactory performance. In addition, depending upon the controller and other factors, an amplifier may not be needed at all. A number of factors affect the selection of the aforesaid components of the aforesaid turbidity measuring device, such as cost, availability, simplicity and convenience. It will be appreciated that the sensor must also be appropriate for the type of electromagnetic radiation to be detected.

An additional feature of a machine for washing articles incorporating the turbidity measuring device in accordance with the present invention includes the capability to perform self-calibration of the turbidity measuring device and to control the intensity of the electromagnetic radiation source. This capability may be included in any of the embodiments of a closed loop feedback control system previously described. In such a closed loop feedback control system, the device for measuring the turbidity of liquid in accordance with the present invention may perform self-calibration by measuring the electromagnetic radiation transmitted, the electromagnetic radiation scattered, or both, when substantially particle-free liquid, such as water, is disposed between the radiation source and the respective electromagnetic radiation sensors. Any signals produced by the device may be compared with appropriate transmission and scatter values of electromagnetic radiation propagated through the substantially particle-free liquid. Signal values provided by the sensors may then be offset by the closed loop feedback control system, such as by a preprogrammed microprocessor or other processor. Signal offsets may correct for source or sensor degradation, provide a reference point, or provide other uses in processing turbidity measurements. These signal offsets may be updated or reset each time the machine is used for a washing. Alternatively, these offsets may be updated and stored to be used in conjunction with a fuzzy logic feedback control algorithm, or any other closed loop feedback control algorithm, to control the amount of offset at a later time.

Signals produced by the turbidity measuring device when substantially particle-free liquid is provided may also be used in a closed loop feedback control system to control the intensity of the source to keep the intensity substantially constant. For example, the current in an electrical circuit including the radiation source may be adjusted. This may be performed by any of the embodiments of a closed loop feedback control system previously described, such as by a preprogrammed microprocessor or other processor. Information regarding these adjustments may also be stored for use with a microprocessor or other processor incorporating a fuzzy logic feedback control algorithm, or any other closed loop feedback control algorithm, to control any later adjustments. For a particular embodiment of the device for measuring turbidity including amplifiers, the amplifier gain, such as the gain associated with the operational amplifier configurations of FIG. 5, may also be adjusted by a closed loop feedback control system using the signals provided by either of the sensors after propagating electromagnetic radiation through substantially particle-free liquid, such as water. Closed loop feedback control of the intensity of the radiation source or the amplifier gain may also be used to ensure that the sensors are operated within appropriate ranges for the detection of electromagnetic radiation. The capability to perform self-calibration, to control source intensity and to adjust amplifier gain in real-time are advantages provided by both the configuration of the turbidity measuring device and by incorporating the device in a machine for cleansing or washing articles that includes a controller, responsive to the turbidity measuring device, that comprises a closed loop feedback control system.

A machine for washing articles, such as a dishwasher or clothes washer, incorporating a device for measuring turbidity in accordance with the present invention may be used according to the following method. Articles, such as laundry or food handling items, may be washed with a liquid, such as water, in at least one wash cycle. The articles may be washed in frame 20 of machine 10, shown in FIG. 1. During a wash cycle, the turbidity of the water or liquid used to wash the articles may be measured at least once. A measurement may be taken by turbidity measuring device 60, illustrated in FIG. 2.

The duration of a wash cycle may be controlled in accordance with one or more of the turbidity measurements taken. Based on the one or more turbidity measurements, a duration for the wash cycle may be selected or determined by electronic circuitry responsive to signals produced by the turbidity measuring device, or alternatively, in accordance with a closed loop feedback control algorithm, such as the fuzzy logic feedback control algorithm disclosed in aforesaid patent application Ser. No. 07/877,302. The wash cycle may then be executed for the selected duration by the washing or cleansing controller which controls the duration by controlling the machine.

Alternatively, where a washing or cleansing occurs in a plurality of wash cycles, the turbidity of the water or liquid used to wash the articles may be measured one or more times, at least during one of the wash cycles. The number of wash cycles may then be controlled in accordance with the turbidity measurements taken. Using the one or more turbidity measurements, the number of wash cycles for that washing may be selected and the articles may be washed using the number of selected wash cycles. Likewise, the duration of each cycle may be selected and the washing executed in the number of cycles selected, each cycle having the duration selected for that cycle. Furthermore, where a washing or cleansing occurs in one or more wash cycles and one or more turbidity measurements are obtained during any or all of the wash cycles, the controller may control the temperature of the liquid in accordance with the turbidity measurements taken, such as with heating element 98 (FIG. 1). In all of these situations, controller 200 (FIG. 1) controls the machine to execute a washing or cleansing in the manner selected.

In washing articles, as described above, the steps of measuring the turbidity of liquid, such as water, may comprise several steps. First, electromagnetic radiation, regardless of polarization, may be propagated through the liquid, such as water, and, regardless of polarization, electromagnetic radiation scattered by particles suspended in the water may be detected as a measure of the turbidity of the water. Alternatively, the method may further include detecting electromagnetic radiation, regardless of polarization, transmitted through the water and comparing the detected scattered electromagnetic radiation with the detected transmitted electromagnetic radiation. Limiting the step of measuring turbidity to these substeps may provide a simple and economic method to achieve excellent performance for use in a method of washing or cleansing articles. Likewise, limiting the step of measuring turbidity to the step of detecting electromagnetic radiation, regardless of polarization, scattered by particles suspended in the liquid, such as water, may provide another economic method of obtaining satisfactory results in various cleansing systems, such as a dishwasher.

While only certain features of the invention have been illustrated and described herein, many modifications, substitutions, changes and equivalents will now occur to those skilled in the art. For example, a device for measuring the turbidity of liquid to be incorporated in a machine for washing or cleansing articles may be used to control other aspects of a washing or cleansing other than heating the liquid and the duration and number of wash cycles. It is, therefore, to be understood that the appended claims are intended to cover all such modifications and changes as fall within the true spirit of the invention.

What is claimed is:

1. A machine for cleansing articles with a liquid comprising:

a source of electromagnetic radiation directed into said liquid;

a sensor for detecting electromagnetic radiation, regardless of polarization, scattered by propagation through said liquid;

a controller responsive to said sensor;

a frame for containing said articles during said cleansing; and liquid-handling means integral to said frame for cleansing said articles in response to said controller.

2. The machine of claim 1, further comprising a sensor for detecting transmitted electromagnetic radiation regardless of polarization, propagated through said liquid;

said controller being further responsive to said sensor for detecting transmitted radiation.

3. The machine of claim 2, wherein said liquid comprises water.

4. The machine of claim 3, wherein the radiation consists essentially of unpolarized radiation.

5. The machine of claim 4, wherein said sensor for detecting transmitted unpolarized radiation is located along an axis substantially defined by the direct path of the transmitted radiation from said source and said sensor for detecting scattered unpolarized radiation is located along an axis oriented substantially perpendicular to the direct path.

6. The machine of claim 5, wherein said controller comprises a closed loop feedback control system.

7. The machine of claim 6, wherein said closed loop feedback control system comprises a microprocessor incorporating a closed loop feedback control algorithm.

8. The machine of claim 7, wherein said cleansing means is operable for a plurality of separate wash cycles under control of said closed loop feedback control system, said closed loop feedback control system for controlling the number and duration of the separate wash cycles.

9. The machine of claim 6, wherein said closed loop feedback control system comprises a microprocessor incorporating a fuzzy logic feedback control algorithm.

10. The machine of claim 9, wherein said cleansing means operates for at least one wash cycle, said closed loop feedback control system controlling the duration of said at least one wash cycle.

11. The machine of claim 9, wherein said cleansing means is operable for a plurality of separate wash cycles of varying durations under control of said closed loop feedback control system, said closed loop feedback control system for controlling the number and duration of the separate wash cycles.

12. The machine of claim 6, wherein said sensor for detecting transmitted unpolarized radiation produces a first signal in response to detected transmitted unpolarized radiation and said sensor for detecting scattered unpolarized radiation produces a second signal in response to detected scattered unpolarized radiation;

said closed loop feedback control system including electronic circuitry for comparing said first signal to said second signal.

13. The machine of claim 6, wherein said closed loop feedback control system comprises a microprocessor incorporating a closed loop feedback control algorithm to provide periodic closed loop feedback control of said cleansing means.

14. The machine of claim 6, wherein said closed loop feedback control system comprises a microprocessor incorporating a closed loop feedback control algorithm to provide continuous closed loop feedback control of said cleansing means.

15. The machine of claim 6, wherein said closed loop feedback control system comprises a microprocessor incorporating a closed loop feedback control algorithm to provide batch closed loop feedback control of said cleansing means.

16. The machine of claim 5, wherein said articles comprise laundry and said machine comprises a clothes washer.

17. The machine of claim 5, wherein said articles comprise food handling items and said machine comprises a dishwasher.

18. The machine of claim 4, wherein said sensor for detecting transmitted unpolarized radiation is located along an axis substantially defined by the direct path of the transmitted radiation from said source and said sensor for detecting scattered unpolarized radiation is located along an axis oriented at an acute angle relative to the direct path.

19. The machine of claim 1, further comprising a second source of electromagnetic radiation;

wherein said sensor is positioned to detect, regardless of polarization, transmitted electromagnetic radiation from said second source propagated through said liquid.

20. The machine of claim 1, wherein the radiation consists essentially of unpolarized radiation.

21. The machine of claim 20, wherein said sensor for detecting scattered unpolarized radiation is located along an axis oriented at an acute angle relative to the path of the radiation from said source before being scattered.

22. The machine of claim 20, wherein said sensor for detecting scattered unpolarized radiation is located along an axis oriented substantially perpendicular to the path of the radiation from said source before being scattered.

23. A method for washing articles comprising the steps of:

(a) washing said articles with water for at least one wash cycle;

(b) during the washing step measuring at least once the turbidity of the water used to wash said articles by:

(1) propagating electromagnetic radiation through the water; and (2) detecting electromagnetic radiation, regardless of polarization, scattered by particles suspended in the water; and (c) controlling the duration of said at least one wash cycle in accordance with the at least one turbidity measurement.

24. The method of claim 23, wherein the step of measuring at least once the turbidity of the water further comprises the steps of:

(1) detecting, regardless of polarization, electromagnetic radiation transmitted through the water; and (2) comparing the detected scattered electromagnetic radiation with the detected transmitted electromagnetic radiation.

25. A method for washing articles comprising the steps of:

(a) washing said articles with water in a plurality of wash cycles;

(b) during at least one of the wash cycles measuring at least once the turbidity of the water used to wash said articles by:

(1) propagating electromagnetic radiation through the water; and (2) detecting electromagnetic radiation, regardless of polarization, scattered by particles suspended in the water; and (c) controlling the number of the wash cycles in accordance with the at least one turbidity measurement.

26. The method of claim 25, wherein the step of measuring at least one the turbidity of water used to wash said articles further comprises the steps of:

(1) detecting, regardless of polarization, electromagnetic radiation transmitted through the water; and (2) comparing the detected scattered electromagnetic radiation with the detected transmitted electromagnetic radiation.

27. The machine of claim 1, and further comprising a sensor holder system including a liquid sample collector and an at least partially translucent tube;

said tube connecting said sample collector to said frame so as to permit liquid to pass between said sample collector and said frame;

said tube further being physically interposed between said radiation source and said radiation sensor so that the electromagnetic radiation scattered by propagation through liquid in said tube may be measured.

28. The machine of claim 27, wherein said sample collector is fixedly mounted to said frame, said sample collector and frame each including substantially mutually overlapping apertures so as to permit liquid to pass from said frame to said sample collector;

said tube connecting said sample collector to said frame so as to permit liquid to pass back to said frame from said sample collector.

* * * * *

US005291626B1

REEXAMINATION CERTIFICATE (2888th)

United States Patent [19] [11] B1 5,291,626

Molnar et al. [45] Certificate Issued May 21, 1996

[54] MACHINE FOR CLEANSING ARTICLES

[75] Inventors: Barbara D. Molnar, Clifton Park; Donald T. McGrath, Scotia; Mark E. Dausch; Vivek V. Badami, both of Schenectady; Walter Whipple, III, Amsterdam, all of N.Y.

[73] Assignee: General Electric Company, Schenectady, N.Y.

Reexamination Request:
No. 90/003,560, Sep. 6, 1994

Reexamination Certificate for:

| | |
|---|---|
| Patent No.: | **5,291,626** |
| Issued: | **Mar. 8, 1994** |
| Appl. No.: | **877,303** |
| Filed: | **May 1, 1992** |

[51] Int. Cl.[6] ..... D06F 33/02; A47L 15/46

[52] U.S. Cl. ..... 8/158; 68/12.02; 134/57 D; 356/339

[58] Field of Search ..... 8/158; 68/12.02; 134/57 D, 113; 356/339

[56] References Cited

U.S. PATENT DOCUMENTS

| | | | |
|---|---|---|---|
| 3,364,812 | 1/1968 | Ewing | 88/14 |
| 3,613,405 | 10/1971 | Shimokusu et al. | 68/12 |
| 3,662,186 | 5/1972 | Karklys et al. | 307/141 |
| 3,713,743 | 1/1973 | Simms | 356/208 |
| 3,790,815 | 2/1974 | Karklys et al. | 134/141 |
| 3,870,417 | 3/1975 | Bashark | 356/208 |
| 3,880,526 | 4/1975 | Kobayashi et al. | 356/208 |
| 3,888,269 | 6/1975 | Bashark | 134/57 |
| 4,152,070 | 5/1979 | Kushner et al. | 356/343 |
| 4,193,692 | 3/1980 | Wynn | 356/341 |
| 4,222,250 | 9/1980 | Torita | 68/12 |
| 4,237,565 | 12/1980 | Torita et al. | 8/158 |
| 4,335,592 | 6/1982 | Torita | 68/12 |
| 4,372,134 | 2/1983 | Matsuo | 68/12 |
| 4,639,137 | 1/1987 | Hazan et al. | 356/339 |
| 4,803,854 | 2/1989 | Kikuchi et al. | 68/12 |
| 4,999,514 | 3/1991 | Silveston | 250/575 |
| 5,048,139 | 9/1991 | Matsumi et al. | 8/158 |
| 5,083,447 | 1/1992 | Kiuchi et al. | 68/12.05 |
| 5,105,635 | 4/1992 | Kiuchi et al. | 68/12.04 |
| 5,140,168 | 8/1992 | King | 250/575 |
| 5,230,227 | 7/1993 | Kondoh et al. | 68/12.02 |

FOREIGN PATENT DOCUMENTS

| | | |
|---|---|---|
| 0193152 | 9/1986 | European Pat. Off. . |
| 2485576 | 12/1981 | France . |
| 1128446 | 9/1968 | United Kingdom . |

OTHER PUBLICATIONS

1990 International Standard, ISO 7027.
1989 Asian Wall Street Journal (Matsushita Aisaigo).
1990 New Technology in Japan (Matsushita).
1990 Korea Economic Daily (Samsung washing machine).
1991 Appliance Manufacturer (Feb. 1991).
1991 Report From Japan (Jan. 1991 Six appliance manufacturers announce washing machines with fuzzy logic).
1991 Japan Economic Journal (Jan. 1991 Matshushita).
ASTM Standard Test Method for Turbidity in Water (1988).
EPA Method 180.1 (Standard Methods for the Examination of Water and Waste Water (circa 1976).

*Primary Examiner*—Philip R. Coe

[57] ABSTRACT

A machine for cleansing articles, such as a dishwasher, incorporates a device for measuring the turbidity of an at least partially transparent liquid. The device includes a sensor for detecting scattered electromagnetic radiation, regardless of polarization, and a sensor for detecting transmitted electromagnetic radiation, regardless of polarization.

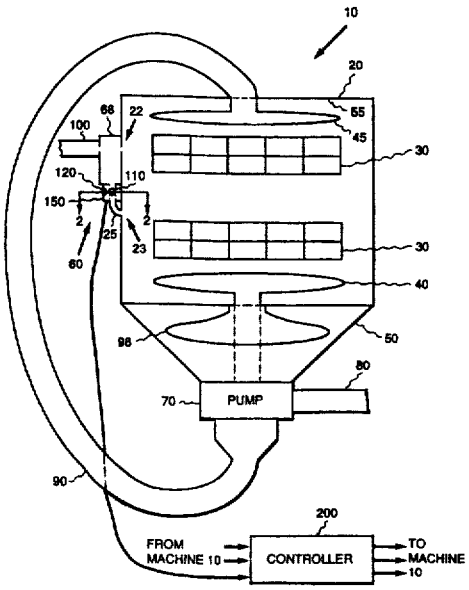

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 4, 16, 17, 19, 20, 24 and 26 are cancelled.

Claims 1, 3, 5, 8, 10–12, 18, 21–23, 25 and 27 are determined to be patentable as amended.

Claims 6, 7, 9, 13–15 and 28, dependent on an amended claim, are determined to be patentable.

1. A *dish washing* machine for cleansing articles with a liquid comprising:

a source of *essentially unfocused, unpolarized* electromagnetic radiation directed into said liquid;

a *first* sensor *positioned* for detecting *unpolarized* electromagnetic radiation[, regardless of polarization,] scattered by propagation through said liquid *and effective to provide signals representative thereof;*

[a controller responsive to said sensor;]

*a second sensor positioned for detecting unpolarized electromagnetic radiation transmitted by propagation through said liquid and effective to provide signals representative thereof;* a frame for containing said articles during said cleansing; [and]

liquid-handling means integral to said frame for cleansing said articles [in response to said controller.]*; and*

*a controller responsive to signals from said first and second sensors and effective to control operation of said liquid-handling means in accordance with substantially concurrent signals from both said first and second sensors.*

3. The machine of claim [2] *1*, wherein said liquid comprises water.

5. The machine of claim [4] *1*, wherein said sensor for detecting transmitted unpolarized radiation is located along an axis substantially defined by the direct path of the transmitted radiation from said source and said sensor for detecting scattered unpolarized radiation is located along an axis oriented substantially perpendicular to the direct path.

8. The machine of claim 7, wherein said [cleansing] *liquid-handling* means is operable for a plurality of separate wash cycles under control of said closed loop feedback control system, said closed loop feedback control system for controlling the number and duration of the separate wash cycles.

10. The machine of claim 9, wherein said [cleansing] *liquid-handling* means operates for at least one wash cycle, said closed loop feedback control system controlling the duration of said at least one wash cycle.

11. The machine of claim 9, wherein said [cleansing] *liquid-handling* means is operable for a plurality of separate wash cycles of varying durations under control of said closed loop feedback control system, said closed loop feedback control system for controlling the number and duration of the separate wash cycles.

12. [The machine of claim 6,] *A machine for cleansing articles with water comprising:*

*a source of essentially unpolarized electromagnetic radiation directed into said water;*

*a sensor for detecting unpolarized electromagnetic radiation, scattered by propagation through said water;*

*a sensor for detecting transmitted unpolarized electromagnetic radiation propagated through said water;*

*said sensor for detecting transmitted unpolarized radiation being located along an axis substantially defined by the direct path of the transmitted radiation from said source and said sensor for detecting scattered unpolarized radiation being located along an axis oriented substantially perpendicular to the direct path;*

*a controller responsive to said sensors, said controller comprising a closed loop feedback control system;*

*a frame for containing said articles during said cleansing; and*

*liquid-handling means integral to said frame for cleansing said articles in response to said controller;* wherein said sensor for detecting transmitted unpolarized radiation produces a first signal in response to detected transmitted unpolarized radiation and said sensor for detecting scattered unpolarized radiation produces a second signal in response to detected scattered unpolarized radiation;

said closed loop feedback control system including electronic circuitry for comparing said first signal to said second signal.

18. The machine of claim [4] *1*, wherein said sensor for detecting transmitted unpolarized radiation is located along an axis substantially defined by the direct path of the transmitted radiation from said source and said sensor for detecting scattered unpolarized radiation is located along an axis oriented at an acute angle relative to the direct path.

21. The machine of claim [20] *1*, wherein said sensor for detecting scattered unpolarized radiation is located along an axis oriented at an acute angle relative to the path of the radiation from said source before being scattered.

22. The machine of claim [20] *1*, wherein said sensor for detecting scattered unpolarized radiation is located along an axis oriented substantially perpendicular to the path of the radiation from said source before being scattered.

23. A method for washing *food handling* articles *in a dish washing machine* comprising the steps of:

(a) washing said articles with water for at least one wash cycle;

(b) during the [washing step] *wash cycle* measuring at least once the turbidity of the water used to wash said articles by:

(1) propagating *essentially unfocused, unpolarized* electromagnetic radiation through the water; [and]

(2) detecting *unpolarized* electromagnetic radiation[, regardless of polarization,] scattered by particles suspended in the water; [and]

*(3) detecting unpolarized electromagnetic radiation transmitted through the water; and*

*(4) comparing the detected scattered electromagnetic radiation with the detected transmitted electromagnetic radiation; and*

(c) controlling the duration of said at least one wash cycle in accordance with the at least one turbidity measurement.

25. A method for washing *food handling* articles *in a dish washing machine* comprising the steps of:

(a) washing said articles *in water* in a plurality of wash cycles;

(b) during at least one of the wash cycles measuring at least once the turbidity of the water used to wash said articles by:

(1) propagating *essentially unfocused, unpolarized* electromagnetic radiation through the water; [and]

(2) detecting *unpolarized* electromagnetic radiation[, regardless of polarization,] scattered by particles suspended in the water; [and]

(*3*) *detecting unpolarized electromagnetic radiation transmitted through the water; and*

(*4*) *comparing the detected scattered electromagnetic radiation with the detected transmitted electromagnetic radiation; and*

(c) controlling the number of wash cycles in accordance with the at least one turbidity measurement.

27. The machine of claim 1, and further comprising a sensor holder system including a liquid sample collector and an at least partially translucent tube;

said tube connecting said sample collector to said frame so as to permit liquid to pass between said sample collector and said frame;

said tube further being physically interposed between said radiation source and said *first and second* radiation [sensor] *sensors* so that the *essentially unpolarized* electromagnetic radiation scattered by *and the essentially unpolarized electromagnetic radiation transmitted by* propagation through liquid in said tube may be measured.

* * * * *